US005119512A

United States Patent [19]

Dunbar et al.

[11] Patent Number: 5,119,512

[45] Date of Patent: Jun. 9, 1992

[54] CUT RESISTANT YARN, FABRIC AND GLOVES

[75] Inventors: James J. Dunbar, Mechanicsville; Mark B. Boone; Robert C. Wincklhofer, both of Richmond, all of Va.; Charles P. Weber, Jr., Monroe, N.C.

[73] Assignee: Allied-Signal Inc., Morris Township, Morris County, N.J.

[21] Appl. No.: 485,805

[22] Filed: Feb. 23, 1990

Related U.S. Application Data

[63] Continuation of Ser. No. 249,523, Sep. 26, 1988, abandoned, which is a continuation-in-part of Ser. No. 140,530, Jan. 4, 1988, abandoned, which is a continuation-in-part of Ser. No. 873,669, Jun. 12, 1986, abandoned.

[51] Int. Cl.[5] ..... A41D 19/00

[52] U.S. Cl. ..... 2/167; 19/145; 57/210; 57/241; 66/174; 139/420 R; 428/225; 428/377; 428/401; 428/902

[58] Field of Search ..... 428/225, 401, 902, 373, 428/377; 2/167; 66/174; 19/145; 57/210, 241; 139/420 R

[56] References Cited

U.S. PATENT DOCUMENTS 4,304,811 12/1981 David et al. ..... 428/229

4,499,716 2/1985 Antal et al. ..... 57/234

*Primary Examiner*—James J. Bell

[57] ABSTRACT

This invention is a cut resistant article comprising a cut resistant jacket surrounding a less cut resistant member. The jacket comprises a fabric of yarn and the yarn consists essentially of a high strength, longitudinal strand having a tensile strength of at least 1 GPa. The strand is wrapped with another fiber or the same fiber. In another embodiment, the invention is a highly cut resistant yarn of at least two nonmetallic fibers. One fiber is inherently cut resistant like high strength polyethylene, polypropylene or aramids. The other fiber in the yarn has a high level of hardness.

15 Claims, 1 Drawing Sheet

CUT RESISTANT YARN, FABRIC AND GLOVES

This application is a continuation of application Ser. No. 249,523, filed Sep. 26, 1988, now abandoned, which is a continuation-in-part of Ser. No. 140,530 filed Jan. 4, 1988, now abandoned, which in turn is a continuation-in-part of Ser. No. 873,669 filed Jun. 12, 1986, now abandoned.

BACKGROUND OF THE INVENTION

The first embodiment of this invention relates to a cut resistant jacket for ropes, webbing, straps, inflatables and the like, more particularly a cut resistant article comprising a cut resistant jacket surrounding a less cut resistant member where the jacket comprises a fabric of a yarn and the yarn consists essentially of a high strength, longitudinal strand having a tensile strength of at least 1 GPa and the strand is wrapped with a fiber.

The second embodiment of this invention relates to cut resistant yarns and their use in protective garments. There are many applications for such protective garments. Meat processing employees exposed to sharp knives require such garments. Metal and glass handlers who must be protected from sharp edges during the handling of materials may use such protective garments. Medical personnel who are exposed to scalpels and other sharp instruments may obtain protection through the use of such garments.

It is known to make cut resistant fabric for gloves used for safety in the meat cutting industry. For example see U.S. Pat. No. 4,470,251, U.S. Pat. No. 4,384,449 and U.S. Pat. No. 4,004,295 all hereby incorporated by reference. It is also known to make a composite line containing two different filamentary materials in the form of a core and a jacket of different tensile strengths and elongations as in U.S. Pat. No. 4,321,854 hereby incorporated by reference. It is also known to make composite strand, cables, yarns, ropes, textiles, filaments and the like in other prior U.S. patents not cited herein.

In the prior art, U.S. Pat. No. 3,883,898 suggests that an aramid fiber, such as "Kevlar", be used in cut resistant gloves that are worn by meat processors. U.S. Pat. No. 3,953,893 teaches using an aramid fiber in cut resistant aprons.

U.S. Pat. No. 4,004,295 suggests the use of a glove composed of yarn of metal wire and a nonmettalic fiber such as an aramid fiber as protection from knife cuts, especially in meat processing plants. U.S. Pat. No. 4,384,449 and 4,470,251 also suggest the use of metal wire in combination with aramid fibers.

U.S. Pat. No. 4,651,514 suggest the use of a yarn composed of a monofilament nylon core that is wrapped with at least one strand of aramid fiber and a strand of nylon fiber. The stated advantage of this yarn over that suggested in, for example, U.S. Pat. No. 4,004,295 is that this yarn is electrically nonconductive.

By ultrahigh molecular weight is meant 300,000 to 7,000,000. Normal molecular weight is then below By fiber herein is meant any thread, filament or the like, alone or in groups of multifilaments, continuous running lengths or short lengths such as staple.

By yarn herein is meant any continuous running length of fibers, which may be wrapped with similar or dissimilar fiber, suitable for further processing into fabric by braiding, weaving, fusion bonding, tufting, knitting or the like, having a denier less than 10,000.

By strand herein is meant either a running length of multifilament end or a monofilament end of continuous fiber or spun staple fibers, preferably untwisted, having a denier less than 2,000, or, regarding the first embodiment only, metal of diameter less than 0.01 inches.

For many applications, cut resistant garments made using the prior art have undesirable disadvantages or limitations. Garments made using only high strength polyethylene or other fibers offer improved levels of cut protection. However, very sharp edges, such as newly sharpened knives, can cut even very cut resistant fibers with only moderate cutting forces. The addition of metal wire to a yarn containing one of the above high strength fibers can improve yarn cut resistance. Even very sharp edges can have difficulty cutting through a yarn made of aramid and metal fiber. However, such yarns are much less flexible due to the stiffness of the metal. If a garment is too stiff the wearer may become fatigued by using it, or in an extreme case may remove the garment and lose the intended protection. Repeated use and flexing of the garment may cause the relatively stiff metal wire to break. In this case it is likely that the broken wire ends will protrude from the yarn. These sharp wires protruding from the garment may scratch the wearer or any objects being handled.

The use of metal wire in a cut resistant yarn makes the yarn electrically conductive. This means that a garment made with such a yarn cannot be used in contact with high-voltage electrical equipment. The use of a nylon monofilament, instead of metal wire, in a cut resistant yarn removes the problem of electrical conductivity. However, the use of nylon monofilament results in a less cut resistant yarn. The nylon is much more easily cut by very sharp edges than is metal wire. Therefore, the yarn as a whole is more easily cut.

The present invention overcomes many of the limitations of cut resistant yarns made using the prior art. The present invention can have a cut resistance equal to or better than that obtained by using yarn containing metal wire, however, it does not have the stiffness or electrical conductivity associated with a yarn containing metal wire.

SUMMARY OF THE INVENTION

The first embodiment of this invention is a cut resistant article comprising a cut resistant jacket surrounding a less cut resistant member. The jacket comprises a fabric of yarn. The yarn consists essentially of a high strength, longitudinal strand having a tensile strength of at least 1 GPa. More than one strand can be used. This strand (or strands) is wrapped with a fiber. The fiber may be the same or different than the longitudinal yarn.

It is preferred that the fiber wrapped around the strand also have a tensile strength of at least 1 GPa.

The less cut resistant member can be selected from the group consisting of rope, webbing, strap, hose and inflatable structures.

The core strand fiber of the rope, webbing, strap or inflatable structures could be fiber of nylon, polyester, polypropylene, polyethylene, aramid, ultrahigh molecular weight high strength polyethylene or any other known fiber for the use.

The inflatable structure would be a less cut resistant layer having the fabric of this invention as a jacket or outer layer. The strand used for the fiber in the jacket may be selected from the group consisting of an aramid, ultrahigh molecular weight polyolefin, carbon, metal, fiber glass and combinations thereof. The fiber used to wrap the longitudinal strand (or strands) can be selected from the group consisting of an aramid fiber, ultrahigh molecular weight polyolefin fiber, carbon fiber, metal fiber, polyamide fiber, polyester fiber, normal molecular weight polyolefin fiber, fiber glass, polyacrylic fiber and combinations thereof. When the fiber wrapping is a high strength fiber having strength over 1 GPa, the preferred fiber wrapping is selected from the group consisting of aramid fiber, ultra high molecular weight polyolefin fiber, carbon fiber, metal fiber, fiber glass and combinations thereof.

The polyolefin fiber of this invention can be ultrahigh molecular weight polyethylene or polypropylene, preferably polyethylene, commercial examples are Spectra® 900 and Spectra® 1000.

The fiber wrapping can also be a blend of a lower strength fiber with the high strength fiber. Such lower strength fiber can be selected from the group consisting of polyamide, polyester, fiber glass, polyacrylic fiber and combinations thereof.

The article of this invention can also have more than one jacket surrounding the less cut resistant member.

In another example of the first embodiment, the article of this invention has a material present in the interstices of the fabric of the jacket to bond the yarn of the fabric to adjacent yarn of the fabric thereby increasing penetration resistance of the jacket. The material used in the interstices can be any elastomer, preferably a thermoplastic rubber and more preferably a material selected from the group consisting of polyurethane, polyethylene and polyvinyl chloride.

In a second embodiment, the present invention is a highly cut resistant composite yarn. The yarn is comprised of at least two fibrous materials. All materials in the yarn are nonmetallic. At least one of the materials is required to be highly flexible and inherently cut resistant. At least one of the materials is required to have a high level of hardness. An example of such a yarn results from the combination of glass fiber, which is a hard fibrous material, and high strength, extended-chain polyethlyene fiber, which is a flexible and inherently cut resistant fibrous material.

Garments, such as gloves, made from yarn of the present invention are highly cut resistant. They are also very flexible and nonconductive.

The present invention differs from the prior art in that a nonmetallic, hard fibrous material is used as a component of the yarn. The only hard fibrous material suggested in the prior art is metal wire. Other materials suggested by the prior art, such as nylon, are not considered hard materials.

It is somewhat surprising that brittle, hard materials, such as glass fibers, can add such a significant level of cut resistance to the composite yarns of the present invention. It would normally be assumed that such brittle materials would easily break and provide little protection when the yarn is impacted with a cutting edge. However, it has been found that when very small diameter glass is used in the core of the yarn, and optionally is protected by an outer wrapping of flexible fiber or elastomeric coating, the composite yarn is very resistant to breakage during cutting.

More specifically, the second embodiment of this invention is a cut resistant yarn comprising at least two nonmetallic fibers with at least one being flexible and inherently cut resistant and at least another having a high level of hardness. The level of hardness is perferred to be above about 3 on the Mohs hardness scale. It is preferred that the cut resistant fiber would be resistant to being cut for at least 10 cycles on the cutting apparatus described in U.S. Ser. No. 223,596 filed Jul. 25, 1988 with cutting weight of 135 gr., mandrel speed of 50 rpm, steel mandrel diameter of 19 mm, blade drop height of 9mm, using a single-edge industrial razor blade for cutting, said fiber being tested as a knitted fabric comprised of 2400 denier fiber, with less than 2 turns per inch of twist, and being knitted on a 10 gauge knitting machine to a fabric of 11 oz. per sq. yd. The preferred cut resistant fiber is selected from the group consisting of high strength polyethelene, high strength polypropylene, high strength polyvinyl alcohol, aramids, high strength liquid crystal polyesters and mixtures thereof. The preferred fiber having the high level of hardness is selected from the group consisting of glass, ceramic, carbon and mixtures thereof. It is preferred that the fiber having a high level of hardness have a diameter of at most about 12 microns, most preferrably the diameter is between about 2 and about 10 microns. Another preferred fiber having a high level of hardness can be a multiple component fiber of any diameter or thickness which can have a softer core material and an outer coating of the hard material, such as glass, ceramic or carbon. Likewise, this hard fiber could be a composite fiber of any thickness wherein the matrix is a softer material impregnated with the hard material such as carbon, glass or ceramic. Mixtures of any of the hard fibers mentioned above would also be useful. The fiber having a high level of hardness can be coated with an elastomeric coating. The second embodiment is also a fabric made from the yarn of the combined fibers described above, and garments such as gloves made of such fabric.

DESCRIPTION OF THE PREFERRED EMBODIMENTS

Figure 1:
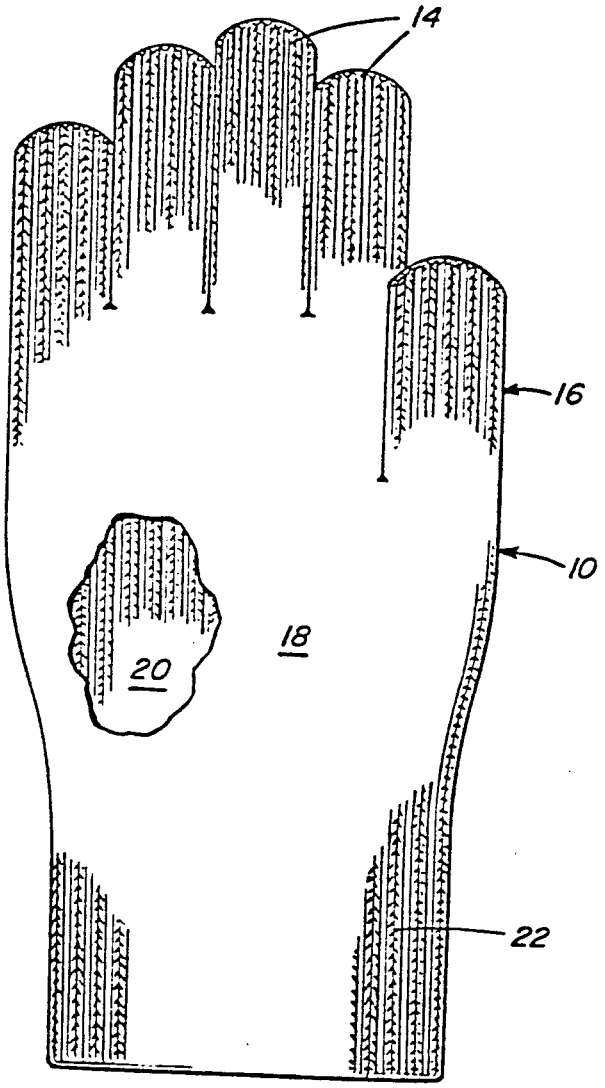
FIG. 1 is a plan view of a protective glove constructed of the yarn having a flexible core.

The drawing illustrates a finished protective glove 10 which is exemplary of a garment or the like constructed from the yarn 12 in which conventional techniques and glove making machinery are employed to form a glove having the usual finger stalls 14, thumb stall 16, front panel 18, rear panel 20 and wrist cuff 22.

Yarns for Jacket Fabric (First Embodiment)

A yarn to be used to make the protective jacket fabric of the first embodiment of this invention is made by wrapping one longitudinal strand of stainless steel wire having a diameter of 0.11 mm and one parallel strand of an ultrahigh molecular weight polyethylene fiber having a tensile strength of 3 GPa modulus of 171 GPa, elongation of 2.7 percent, denier of 650 and 120 filaments per strand or end. This yarn is commercially available as Spectra®1000 fiber from Allied Corporation. The wrapping fiber is a polyester of 500 denier, 70 filaments per end, having a tensile strength of 1.00 GPa, modulus of 13.2 GPa, elongation of 14 percent. For yarn A two layered wraps of the above polyester fiber are used to wrap the parallel strands of wire and high strength polyethylene.

For yarn B one layer of the ultrahigh molecular weight polyethylene fiber described above is used as the innermost layer wrapped around the strands, the outer layer being the polyester fiber.

Alternatively, an aramid such as Kevlar could be used to replace the ultrahigh molecular weight polyethylene, either as the strand or as the fiber for wrapping.

Comparative Yarn C—a polyester of 3600 denier, 1 GPa tensile strength, 13.2 GPa modulus and 14 percent elongation, without wrapping.

This wrapped yarn (A or B) or comparative yarn C can then be braided, knitted, woven or otherwise made into fabric used as the jacket of this invention.

This jacket can then be used to surround ropes, webbing, straps, inflatable structure, and the like. The jacket can be made from one or more ends of yarn per carrier in the braider apparatus. Either full or partial coverage of the core of braided or parallel strands can be achieved. The yarn for the fabric used for the jacket in this invention can also be wrapped in a conventional manner such as simply wrapping the strand of high strength fiber or by core spinning or by Tazalanizing or any other method to put a wrap of yarn around the strand or strands.

Cut Resistant Yarn (Second Embodiment)

The yarn of the second embodiment of the present invention is comprised of at least two fibrous materials, with at least one being flexible and cut resistance and at least another which must have a high level of hardness. The desirability of using this particular combination of materials has been made apparent through careful observation of the cutting action of sharp edges against various fibrous materials.

It is known that certain fibrous materials have an inherently high level of cut resistance. For example, aramid fibers, such as "Kevlar", are difficult to cut compared to most other synthetic fibers. As an example, more force is required to cut through an aramid fiber than through an equivalent amount of polyester fiber, assuming the cutting edge sharpness is the same in both cases.

It has been observed that extended-chain polyethylene (ECPE) fibers, such as "Spectra", are also inherently cut resistant. ECPE fibers, in addition to being highly cut resistant, are very abrasion resistant and flexible, providing a superior cut-resistant yarn.

The present invention requires that at least one of the fibrous materials in the yarn be a flexible, inherently cut resistant material such as, but not limited to, an aramid fiber or ECPE fiber.

While materials such as aramid fibers and ECPE fibers are cut resistant, even they can be cut through with relatively moderate force if an extremely sharp edge is used during cutting and if the edge is pulled across the material while the cutting force is being applied. In the course of developing the present invention it was discovered that adding a hard fibrous material to the flexible, inherently cut resistant material dramatically increased the cut resistance of the yarn. It was discovered that the hard material dulled the cutting edge during the cutting process, and as a result made it more difficult for the edge to cut through.

The assumption that the hard material was responsible for dulling the sharp edge and making it more difficult to cut e yarn was verified by the following simple test. A sample of knitted ECPE fabric was cut with a previously unused scalpel blade. Enough force was applied, by hand, as the scalpel was pulled across the fabric to cut through the fabric. Next, a similar unused scalpel blade was brought in contact with a 25 denier glass fiber. The cutting edge of the scalpel was pulled over the glass fiber under moderate hand pressure, the pressure being not so great as to break the glass fiber, such that the entire cutting edge made contact with the glass fiber. This scalpel was then used to cut the ECPE fabric mentioned before. It was found that the force required to cut through the fabric was greatly increased for this case. It was obvious that pulling the scalpel edge over the glass fiber had reduced the sharpness of the edge. It was found that if the scalpel edge was repeatedly made to contact the glass fiber, the edge could be dulled to the extent that the ECPE fabric could not be cut through at any level of hand pressure. In contrast, if a previously unused scalpel was used to repeatedly cut the ECPE fabric, the force required to cut did not increase with the number of cuts. It was obvious that the ECPE was not noticeably dulling the scalpel edge.

For the purposes of this invention, any nonmetallic, hard fibrous material may be used. Glass fibers and ceramic fibers are common examples of such materials. For the purposes of this invention, "hard" material is any material that has a hardness level such that it is capable of significantly reducing the sharpness of a cutting edge.

The form that the hard fibrous material takes can be quite varied. The hard fibrous material can be of uniform composition and continuous in length, such as a continuous filament glass fiber. It may be of noncontinuous length, such as chopped glass fiber. It may be nonuniform in composition. For example, the fibrous material may be composed of an organic fiber coated with layer of ceramic material. Another example would be that of an organic fiber which is impregnated with ceramic particles or fibrils. The foregoing examples are for illustration only in that numerous modifications can readily be imagined by one skilled in the art.

An assumption that might be made, even by one skilled in the art, is that hard fibrous materials used as part of this invention would be very brittle and, therefore, of limited use in garments. In practice, the brittleness of the hard materials used is not a major concern. The glass or ceramic fibers that would normally be used in this invention are extremely small in diameter. If larger diameter is required, a coated or impregnated fiber, described above, can be used. As a result, these hard materials are still very flexible and can be bent around a very small radius without breaking. It is preferred that the hard fibrous material be placed in the core of the composite yarn. In this manner, the hard material is exposed to the least stress during bending of the yarn. In addition, by placing the hard material in the core of the yarn, the outer layers of flexible, inherently cut resistant material help protect the more brittle core material.

In many cases, it will be preferred that the hard fibrous material be coated with a continuous layer of elastic material. This coating has several important functions. If the hard material is a multifilament fiber, the coating holds the fiber bundle together and helps protect it from stresses that develop during handling of this fiber before it is placed in the composite yarn. The coating may provide a physical barrier to provide chemical protection for the hard material. Additionally, if the hard material is broken during use, the coating will trap the material so that it will not leave the yarn structure.

A cut testing apparatus useful to measure the cut resistance of fibers and yarns of this invention is described in U.S. Pat. No. 4,864,852 hereby incorporated by reference, in toto. For purposes of this invention, "the cut testing apparatus" shall mean the above-described apparatus.

EXAMPLE 1

Tests on Ropes (First Embodiment)

Three different stranded ropes, jacketed with a cut protective fabric, were tested for cut resistance. Three conventional stranded ¼-inch (0.6 cm) ropes were made and a special braided yarn fabric was used to surround the rope core as a jacket. The jacket can be formed either separately and placed on the core of rope or formed around the core during one of the manufacturing steps.

Comparative Sample 1 was a Kevlar stranded rope jacketed with fabric braided from comparative yarn C. Comparative Sample 2 was an ultrahigh molecular weight high strength polyethylene (Spectra® 900) fiber stranded rope jacketed with fabric braided from comparative yarn C. Example of this invention Sample 3 was the above-described ultrahigh molecular weight polyethylene (Spectra®) fiber strand rope, surrounded with a jacket braided from Yarn A. Spectra 900 fiber has a denier of 1200, 118 filaments per strand typically, tensile strength of 2.6 GPa, modulus of 120 GPa and elongation of 3.5 percent.

The three jacketed ropes were tested by a guillotine test. In the guillotine test, the rope was held in a fixture so its movement was restricted. Clamps prevented it from moving along its axis and the rope was inside two pieces of pipe to prevent it from deflecting during cutting. The two pieces of pipe were separated very slightly where the blade made the cut. The maximum force needed to completely sever the rope was measured.

In the second test, the cut-damage test, the rope was laid on a wooden surface without further restraint. A blade was then forced into the rope at 250 pounds (113.6 kg) of force. The damaged ropes were tested for retained strength. In both tests a new Stanley blade no. 1992 was used for each sample tested. The results of the tests are given below.

| | Guillotine Test Results Pounds of Force to Cut | | | | | |
|---|---|---|---|---|---|---|
| | Comparative Sample 1 | | Comparative Sample 2 | | Sample 3 | |
| Test | | (kg) | | (kg) | | (kg) |
| 1 | 132 | (60) | 227 | (103) | 684 | (311) |
| 2 | 139 | (61.8) | 335 | (152) | 638 | (290) |
| 3 | 144 | (65.5) | 286 | (130) | 616 | (280) |
| Avg. | 138 | (62.7) | 282 | (128) | 646 | (294) |
| | Cut Damage Test Results, Percent Strength Retained | | | | | |
| | 73 | | 85 | | 97 | |

Observation of the cut damage test ("abused") ropes showed that the Sample 1 rope was cleanly cut part way through. The Sample 2 rope jacket was also partly cut through but the filaments were not as cleanly cut. Sample 3 rope showed only a depression where the blade was pressed. There was no evidence of even the jacket having been cut. Because of this only Sample 3 rope was tested at 500 pounds force in the cut damage test. It retained 92 percent strength and sustained no jacket cutting.

EXAMPLE 2

Abrasion Resistance (First Embodiment)

Comparative Sample 2 and Sample 3 (this invention) were tested for abrasion resistance of the jacket by the test described below. Sample 3 was a ¼-inch (0.6 cm) stranded rope jacketed with a braided fabric of yarn A.

In the test each sample rope was bent in a 90 degree angle over a 10-inch (25.3 cm) diameter abrasive wheel. The ropes were loaded with 180 pounds (81.8 kg) and reciprocated through a 3-inch (7.6 cm) stroke as the abrasive wheel rotated at 3 rpm. The test ended when the jacket wore through. The number of strokes (cycles) for each was 8 for Comparative Sample 2 and 80 for Sample 3.

EXAMPLE 3

Braided Rope (First Embodiment)

Four ¼-inch (0.6 cm) braided ropes were tested with various jackets. Comparative Sample 4 rope was braided from the high strength, ultrahigh molecular weight polyethylene yarn described above and the jacket was braided from a polyester yarn of 1000 denier, 192 filaments per end, 1.05 GPa tensile strength, 15.9 GPa modulus, and 15 percent elongation.

Sample 5 rope was braided from Kevlar yarn of 1875 denier, 2.53 GPa tensile strength, 60.4 GPa modulus and 3.5 percent elongation. The jacket was as in Sample 3.

Sample 6 rope was also braided, from the high strength ultrahigh molecular weight polyethylene yarn described above, under low tension to give a "soft" rope. The jacket used was as in Sample 3.

Sample 7 rope was identical to Sample 6 except more tension was applied during braiding of the rope to create a "hard" rope.

A fixed load was applied to the rope as in Example 1. When the ropes were taut under the knife, there was little difference in cut resistance between ropes. In the cut damage test, the results are below.

| Cut Damage Tolerance Percent Strength Retained Sample | | | |
|---|---|---|---|
| 4 | 5 | 6 | 7 |
| 43 | 54 | 100 | 82 |

The following is the best mode of the first embodiment of this invention.

It is believed the most cut resistant structure, rope, webbing or strap, would use either of the above described ultrahigh molecular weight polyethylene fibers as core, either braided or as strands, covered by a jacket made, preferably braided, from a yarn having the inner strands of 0.11 mm stainless laid parallel to a strand of the ultrahigh molecular weight polyethylene fiber of highest tensile strength (Spectra 1000), the strands being wrapped with an inner wrap of the lower tensile strength polyethylene fiber (Spectra 900) and outer wrap of polyester fiber described in yarn B, above.

A laboratory study of eleven lines was undertaken by an independent laboratory to ascertain the degree of fishbite resistance which each one might have when used as a deep sea mooring line. In addition to general considerations based upon the composition and construction of the lines, three laboratory tests were used for objective measurement of resistance to stabbing and cutting. Tests were run on the lines when unstressed and when under a working load.

CONSTRUCTION OF LINES

All of the test lines had cores composed of parallel synthetic fibers. Six lines had cores of polyester fiber. Three had cores of Kevlar fiber, and one had a core of Spectra® 900.

The cores of lines with polyester cores were wrapped with a tape of polyester cloth which in turn was covered by a braided polyester cover. The cores of ropes from other sources had a wrapping which appeared to be the same. Table I contains a summary of information on the test lines. Sample 9 is illustrative of the first embodiment of the invention herein using polyurethane in the interstices. All other samples are thought to be comparative.

TEST METHODS

Resistance to penetration by sharp points was measured in two ways: 1) using the Shore D scale of a Durometer (ASTM method #2240), and by stabbing with a simulated shark tooth of hardened steel as described in the "Deep-Sea Lines Fishbite Manual" (Prindle & Walden, 1975). Each data point from the penetration tests is an average of five measurements of the force required to pierce the surface of a line to a standard distance.

Force-to-Cut tests were run on unstressed line samples using the Baldwin Universal Testing Machine as described and illustrated in the "Deep-Sea Lines Fishbite Manual."

In so far as possible within constraints of time and availability of materials, stab and cut tests were repeated on the lines loaded with 1125 lbs. tension. The load was applied by lifting a weight with the test line. The ends of most rope specimens were secured by means of a "Chinese finger" method in which the end of the test line was inserted inside a hollow braid rope which secured it by friction when tension was applied. Durometer and Stab tests were run in the usual ways, but Force-to-Cut tests were done with the cutting blade mounted in a stirrup which was used to pull the blade across the test line. This method is also illustrated in the "Deep-Sea Lines Fishbite Manual" using a shark jaw as the cutting instrument.

All cutting force data are the result of single cuts on the lines indicated. Tests were run on line samples at ambient conditions of approximately 70° F. and variable relative humidity.

LABORATORY TEST RESULTS

Data from three previously tested 13/32" diameter polyester ropes both unprotected and armored have been added as standards of reference. Of the two armors, acetal copolymer (Celcon M25-04) confers a high degree of bite resistance. When tested at sea, it proved adequate to protect a line under strong biting attack. Unfortunately, the Celcon M25-04 formulation cracked during handling so it is not a practical armor, but it is useful here as an example of material with the degree of toughness needed. The second reference line was armored with nylon 6/6 (Zytel ST 801). It is typical of many plastic covered lines in that it has good handling qualities but it is less bite resistant than the acetal copolymer. It is regarded as a marginal fishbite armor marking the bottom of the range of acceptable materials. If a jacket has less stab and cut resistance than nylon 6/6, it probably would not be a trustworthy barrier against fishbite damage in all situations.

Results of the laboratory tests are summarized, and where available, the generic and trade names of fibers and plastic jackets are given in Table II. The thickness of plastic jackets was measured on pieces taken from the test lines and is noted in parentheses after each generic name. A few data are missing, as in the case of sample #1, where the available sample was destroyed in #6 is a duplicate with a heavier jacket. Problems in finding adequate terminations for lines #10 were not resolved in time for this report, so they were not tested under tension.

EVALUATION OF THE LINES

Due to the variety of line constructions, and the characteristics of test methods, there is no obvious winner in all categories. To aid in interpreting the data, tables have been prepared for each test used.

Table III illustrates data obtained with the Durometer and it is evident that by this test none of the lines submitted was equal to either of the armored reference lines i.e. Acetal Copolymer (AC) or Nylon (N), when tested without tension. The best of the test lines were #1 armored with 47 mils of ionomer, #6 armored with 76 mils of ionomer, and #10 armored with 114 mils of polyester. The rest were below a level which would seem to warrant further consideration. However, some mention should be given to the samples armored with braids. They are #7 armored with polyolefin and aluminum braid, #8 armored with Kevlar braid, and #9 armored with polyurethane and a metal braid. All three ranked low in the Durometer test, probably because the conical point of the Durometer slipped between the strands of the braids. #8, which ranked last in this test, was first in cut resistance. Hence, it appears that the Durometer test may be a useful measure of toughness for homogeneous plastic armors, but is not the whole story when used on items with a discontinuous cover.

In all cases where lines were tested slack and again when stressed, the Durometer readings were either the same within experimental error or increased when the line was under tension.

STAB TEST

The single tooth stab test is similar to the Durometer test in that a point is forced into the line, but there is the added possibility of cutting by the tooth edges. Table IV illustrates the relative resistance of the lines under this test.

When the lines were tested slack, the Acetal Copolymer (AC) was again the most resistant, requiring 63 lbs. to pierce. Second place went to #10, armored with 114 mils of polyester. It had 70% the resistance of the acetal copolymer reference line and out performed the Nylon 6/6 (N) reference standard. Next in line was item #9, armored with polyurethane and braid. The next few spots went to items #1, 5, 6, and 7 with only 71% the stab resistance of the marginally acceptable nylon 6/6 covered line.

Tension produced marked changes in the ratings. #1 spot went to item #9, urethane and braid armor, which rose from 35 lbs. resistance to 58 lbs. Under tension, it was substantially equal to acetal copolymer in the unstressed condition. With tension, there were 3 lines closely competitive for second place at a level of about 38 lbs. which is the same as the acetal copolymer reference line, and better than the nylon 6/6 armored line at 31 lbs. All three braid-covered lines showed an increase in resistance to stabbing when a tensile load was applied.

FORCE TO CUT

In the cutting force test, unlike the others, progress of the cutting edge can only be made when armor and fibers have been severed. The test results shown in Table V are now quite different.

Four of the test lines were more resistant to cutting than the two reference lines, both in the relaxed and in the stressed conditions.

With two outstanding exceptions, items #8 and 9, all lines lost cut resistance when tested under tension. The five lines which were comparable to the nylon 6/6 reference, when tested slack, dropped to levels so low as to eliminate them from further consideration.

CHOICE OF LINES FOR TEST AT SEA

A choice of lines for test at sea is complicated by variables in line materials and construction. Overall, there are three kinds of constructions represented:

1. Ropes armored with a layer of plastic only.
2. Ropes covered with a braid only.
3. Ropes jacketed with a combination of braid and plastic.

A review of the test data as illustrated in Tables III, IV and V together with available information on the lines will show that there is at least one rope in each category that merits further study.

Taking the lines in order of their overall resistance to puncture and cutting, the best five lines are as follows:

Sample 10—⅝" dia. Kevlar rope armored with 114 mils of polyester (Hytrel). This line is bulky and very stiff. It could only be handled with heavy machinery. Unfortunately, a method for terminating this line could not be managed in time for this report, but results on the unstressed line indicate that it is worth consideration for further tests.

Sample 9—¼" dia. rope of Spectra ® 900 fiber coated with a polyurethane over SPECTRA fiber plus metal core yarn braid jacket. This line is flexible and has good handling qualities. It is vulnerable to stabbing when slack but gains resistance when under a working load. It was superior to the acetal copolymer reference line in resistance to cutting. 15 Information on the susceptibility to deterioration in sea water is needed to complete the information required for an unqualified recommendation of this line for a test at sea.

Sample 7—5/16" dia. Kevlar rope with polyolefin and aluminum braid armor. The armor on this line was composed of 35 mils of polyolefin over the Kevlar fiber plus a layer of aluminum braid plus 41 mils of polyolefin. It was a good handling line albeit a bit stiffer than some others. The Durometer test was below that of nylon 6/6. Stab test on the relaxed rope was below that of nylon 6/6 but when the line was loaded it became much more resistant to stabbing and was about equal to acetal copolymer. In the cut test, it ranked third when unstressed and when stressed, it was superior to both of the reference lines. This is a good line and worth a test at sea.

Sample 6—½" dia. polyester fiber (SynCore) rope with 76 mils of ionomer (Surlyn) jacket. This line had good handling properties, however, overall it was a little below the nylon 6/6 reference line in the three tests. It would be interesting in a test at sea as a line with minimal resistance for the job of fishbite prevention.

Sample 8—⅝" dia. Kevlar with a coarse Kevlar braided jacket. This line was interesting in that it was near the bottom in resistance to penetration, especially when slack, however, it was number one in cut resistance. The effect of tension was to increase its resistance in all three tests. Loaded, it became so resistant to cutting that the steel blade was broken before the line suffered any significant damage. More testing of this type of line with reference to fishbite is definitely indicated.

Overall, the results indicate that braids have interesting properties in resistance to cutting but they are susceptible to penetration by sharp points especially when a line is slack. Plastic armors, on the other hand, lose cut resistance when stretched. Combinations of the two should probably be investigated further toward making a line with effective bite resistance under all conditions.

TABLE I

Lines submitted for laboratory tests Relative to Fishbite resistance

| Sample No. | Construction: Core (All lines parallel fiber core) | Construction: Jacket (mils) |
|---|---|---|
| 1 | ½" polyester | Ionomer (47) Surlyn |
| 2 | " | Polyurethane Texin |
| 3 | " | Thermoplastic elastomer (41) Kraton |
| 4 | " | Thermoplastic elastomer (43) Santoprene |
| 5 | " | Polyester (52) Hytrel |
| 6 | " | Ionomer (76) Surlyn |
| 7 | 5/16" Kevlar | Polyolefin and aluminum braid |
| 8 | ⅝" Kevlar | Kevlar braid |
| 9 | ¼" Spectra | Urethane coated braid* |
| 10 | ⅝ Kevlar | Polyester (114) Hytrel |

*braid made from yarn of strands of SPECTRA ® fiber combined with stainless wire, first wrapped with SPECTRA fiber, then wrapped with polyester fiber.

TABLE II

Resistance of lines to cutting and stabbing

| Sample Number | Construction: Core | Construction: Jacket (mils) | Durom.-Shore D: Un-Stressed | Durom.-Shore D: 1125 lb. Tension |
|---|---|---|---|---|
| 1 | ½" Polyester | Ionomer(47) | 65 | — |
| 2 | " | Polyurethane (56) | 34 | 44 |
| 3 | " | Thermoplastic elastomer(41) | 23 | 28 |
| 4 | " | Thermoplastic santoprene(43) | 19 | 28 |
| 5 | " | Polyester (52) | 49 | 52 |
| 6 | Polyaramide | Ionomer (76) | 65 | 66 |
| 7 | 5/16" Kevlar | Polyolefin and aluminum braid | 50 | 51 |
| 8 | ⅝" Kevlar | Kevlar braid | 14 | 30 |
| 9 | ¼" Spectra | Polyurethane coated braid** | 46 | 51 |
| 10 | ⅝" Kevlar | Polyester (114) | 59 | — |
| AC | 13/32" Polyester | Acetyl copolymer (78) | 81 | — |
| N | 13/32" Polyester | Nylon 6/6 (63) | 78 | — |
| O | 13/32" Poly- | None | — | — |

TABLE II-continued

| Resistance of lines to cutting and stabbing | | | | |
|---|---|---|---|---|
| ester | | | | |
| | Stab Force-lbs. | | Cut Force-lbs. | |
| Sample Number | Unstressed | 1125 lb. Tension | Un-Stressed | 1125 lb. Tension |
| 1 | 28 | — | 115 | — |
| 2 | 23 | 31 | 97 | 22 |
| 3 | 11 | 22 | 98 | 14 |
| 4 | 12 | 17 | 34 | 6 |
| 5 | 27 | 36 | 107 | 23 |
| 6 | 29 | 38 | 107 | 45 |
| 7 | 27 | 38 | 306 | 264 |
| 8 | 13 | 50 | 377 | >480 |
| 9 | 35 | 58 | 221 | 300 |
| 10 | 44 | — | 352 | — |
| AC | 63 | 38* | 121 | >45* |
| N | 39 | 31* | 104 | >37* |
| O | — | — | 14 | 2* |

**See footnote Table 1
*1200 lbs. tension on the line

TABLE III

| Durometer Test | | | | |
|---|---|---|---|---|
| Sample No. | Armor Material Thickness Mils | Rank | Resistance to Reaction Durometer - Shore D Unstressed | Under Tension |
| 1 | 47 | 3 | 63 | — |
| 2 | 56 | 8 | 36 | 43 |
| 3 | 41 | 9 | 23 | 25 |
| 4 | 43 | 10 | 19 | 24 |
| 5 | 52 | 6 | 48 | 52 |
| 6 | 76 | 3 | 63 | 64 |
| 7 | — | 5 | 48 | 50 |
| 8 | — | 11 | 14 | 26 |
| 9 | — | 7 | 44 | 52 |
| 10 | 114 | 4 | 58 | — |
| AC | 78 | 1 | 80 | — |
| N | 63 | 2 | 78 | — |

TABLE IV

| Stab Test | | | |
|---|---|---|---|
| Sample No. | Rank | Force to Stab-lbs. Unstressed | Under Tension |
| 1 | 6 | 26 | — |
| 2 | 8 | 23 | 31 |
| 3 | 11 | 12 | 21 |
| 4 | 10 | 13 | 17 |
| 5 | 7 | 24 | 38 |
| 6 | 5 | 28 | 38 |
| 7 | 7 | 24 | 38 |
| 8 | 9 | 14 | 16 |
| 9 | 4 | 35 | 58 |
| 10 | 2 | 43 | — |
| AC | 1 | 63 | 38 |
| N | 3 | 39 | 31 |

TABLE V

| Force to Cut | | | |
|---|---|---|---|
| Sample No. | Rank | Force to Cut-lbs. Unstressed | Under Tension |
| 1 | 6 | 110 | — |
| 2 | 10 | 95 | 20 |
| 3 | 9 | 95 | 15 |
| 4 | 11 | 25 | 5 |
| 5 | 7 | 105 | 20 |
| 6 | 7 | 105 | 30 |
| 7 | 3 | 310 | 270 |
| 8 | 1 | 360 | >480 |
| 9 | 4 | 230 | 300 |
| 10 | 2 | 340 | — |
| Unjacketed | 12 | 10 | 5 |
| AC | 5 | 230 | >30 |

TABLE V-continued

| Force to Cut | | | |
|---|---|---|---|
| Sample No. | Rank | Force to Cut-lbs. Unstressed | Under Tension |
| N | 8 | 105 | >25 |

Example of Second Embodiment

Tests of Cut Resistant Fabrics

Sample A was a knitted glove made from a ECPE fiber, Spectra 1000. The glove was knitted on a 7 gauge Shima Seiki glove knitting machine. The yarn used to produce the glove was composed of 2 ends of 1200 denier fiber, with 1 turn per inch twist in each fiber end, resulting in a total yarn denier of 2400. The glove fabric was approximately 0.045 inches thick, with a weight of approximately 13.8 oz. per sq. yd.

Sample B was a woven fabric made using glass fiber (E-glass). The fabric was a satin weave 57×54, using 595 denier untwisted glass fiber, with a thickness of 0.009 inches and a weight of 8.9 oz. per sq. yd.

Sample C was a knitted glove made from the combination of ECPE fibers (Spectra 1000) and a glass fiber (E-glass). The yarn used in the glove was constructed by placing a 595 denier glass fiber and a 650 denier ECPE fiber in the yarn core, with no twist, and wrapping the core in one direction with 650 denier ECPE fiber and then wrapping in the other direction with another 650 denier ECPE fiber. The composite yarn denier was 2900. The glove was knitted on a 7 gauge Shima Seiki glove knitting machine. The glove fabric was approximately 0.055 inches thick, with a weight of approximately 18 oz. per sq. yd.

The test used to measure the cut resistance of the mentioned samples is described in copending U.S. Ser. No. 223,596. The test involves repeatedly contacting a sample with a sharp edge until the sample is penetrated by the cutting edge. The higher the number of cutting cycles (contacts) required to penetrate the sample, the higher the reported cut resistance of the sample. During testing, the following conditions were used: 135 grams cutting weight, mandrel speed of 52 rpm, rotating steel mandrel diameter of 19 mm, cutting blade drop height of 9 mm, use of a single-edged industrial razor blade (Red Devil brand) for cutting, cutting arm distance from pivot point to center of blade being 6 inches. The two glove fabrics (sample A and C) were tested by cutting fingers from the gloves and mounting the finger on the tester mandrel. The fingers were held on the mandrel with a band clamp placed over the cut end of the fingers. The woven fabric sample (sample B) was tested by cutting a 2 by 2 inch piece from the fabric, wrapping the sample around the tester mandrel and holding it on the mandrel with adhesive tape. The woven fabric was mounted so that the cutting blade did not contact the sample where the mounted fabric edges overlapped. The cutting cycles reported are an average of multiple tests. For each test a new, unused razor blade was used so that the sharpness of the cutting edge was the same for each test.

| | Sample A | Sample B | Sample C |
|---|---|---|---|
| Cutting Cycles to Penetrate Sample | 45 | 1 | 114 |
| Fabric Thickness (mils) | 45 | 9 | 55 |

-continued

| | Sample A | Sample B | Sample C |
|---|---|---|---|
| Fabric Weight (oz/sq. yd.) | 13.8 | 8.9 | 18 |
| Cycles per Thickness (cycles/mils) | 1.0 | 0.1 | 2.1 |
| Cycles per Weight (cycles/oz/sq. yd.) | 3.3 | 0.1 | 6.3 |

It is surprising that adding glass fiber to ECPE fibers (sample C) can result in such a large increase in the cut resistance of the fibers. It is clear that the glass fiber by itself offers very little cut resistance. The glass fibers are easily broken during the impact of the cutting process, when used alone. A synergistic effect is observed when ECPE fibers and glass fiber are combined to produce a cut resistant yarn.

For this comparative testing, a woven glass fabric was used because of its availability. It would have been desireable to test a knitted glass fabric as well. However, glass fibers are difficult to knit due to their brittleness and such fabrics were not readily available. It is not expected that a knitted glass fabric would have a significantly different level of cut resistance as compared to a woven glass fabric.

We claim:

1. A protective fabric made from cut resistant yarn comprising at least two dissimilar non-metallic fibers, at least one non-metallic fiber being flexible and inherently cut resistant and the other of said non-metallic fibers having a level of hardness at above about three Mohs on the hardness scale.

2. A protective fabric of claim 1 wherein the fabric is a glove having finger stalls, thumb stall, front panel, rear panel and wrist cuff.

3. The process of claim 1 wherein the fabric is a glove having finger stalls, thumb stall, front panel, rear panel and wrist cuff.

4. The fabric of claim 1 wherein the inherently cut resistant fiber is resistant to being cut through for at least about 10 cycles on the cut testing apparatus with a cutting weight of 135 grams, mandrel speed of 50 rpm, steel mandrel diameter of 19 mm, blade drop height of 9 mm, using a single-edged industrial razor blade for cutting, said fiber being tested as a knitted fabric comprised of 2400 denier fiber, with less that two turns per inch twist, and being knitted on a 10-gauge knitting machine to produce a fabric weight of about 11 ounce per square yard.

5. The fabric of claim 1 wherein the inherently cut resistant fiber is selected from the group consisting of high strength polyethylene, high strength polypropylene, high strength polyvinyl alcohol, aramids, high strength liquid crystal polyesters and mixtures thereof.

6. The fabric of claim 1 wherein the fiber having a high level of hardness is selected from the group consisting of glass, ceramic, carbon and mixtures thereof.

7. The fabric of claim 1 wherein the fiber having a high level of hardness is a multiple component fiber comprised of a softer core material that is coated with a hard material selected from a group consisting of glass, ceramic, carbon and mixtures thereof.

8. The fabric of claim 1 wherein the fiber having a high level of hardness is a composite fiber comprised of a softer material that is impregnated with a hard material selected from the group consisting of glass, ceramic, carbon and mixtures thereof.

9. The fabric of claim 1 wherein the fiber having a high level of hardness is coated with an elastomer coating.

10. The fabric of claim 1 wherein the fiber having a high level of hardness has a diameter of less than about 12 microns.

11. The fabric of claim 1 wherein the inherently cut resistant material is an outer layer.

12. A process to make a cut resistant fabric comprising combining a plurality of dissimilar nonmetallic fibers to form a yarn and then constructing a fabric from said yarn, at least one said nonmetallic fiber being flexible and inherently cut resistant and at least one other said nonmetallic fiber having a level of hardness at about 3 on the Mohs hardness scale.

13. The process of claim 12 wherein the inherently cut resistant fiber is resistant to being cut through for at least about 10 cycles on the cut testing apparatus with a cutting weight of 135 grams, mandrel speed of 50 rpm, steel mandrel diameter of 19 mm, blade drop height of 9 mm, using a single-edged industrial razor blade for cutting, said fiber being tested as a knitted fabric comprised of 2400 denier fiber, with less than two turns per inch twist, and being knitted on a 10-gauge knitting machine to produce a fabric weight of about 11 ounce per square yard.

14. The process of claim 12 wherein the inherently cut resistant fiber is selected from the group consisting of high strength polyethylene, high strength polypropylene, high strength polyvinyl alcohol, aramids, high strength liquid crystal polyesters and mixtures thereof.

15. Process of claim 12 wherein the fiber having a high level of hardness is selected from the group consisting of glass, ceramic, carbon and mixtures thereof.

* * * * *